US009127489B2

(12) United States Patent
Orlov et al.

(10) Patent No.: US 9,127,489 B2
(45) **Date of Patent: *Sep. 8, 2015**

(54) DOOR STOP WITH SECURITY LOCK

(71) Applicant: Adam Orlov, Chicago, IL (US)

(72) Inventors: Adam Orlov, Chicago, IL (US); Stuart Mitchell, St. Paul, MN (US)

(73) Assignee: Adam Orlov, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/486,192

(22) Filed: Sep. 15, 2014

(65) Prior Publication Data

US 2015/0000354 A1 Jan. 1, 2015

Related U.S. Application Data

(63) Continuation-in-part of application No. 13/861,215, filed on Apr. 11, 2013, now Pat. No. 8,863,561.

(51) Int. Cl.

| | |
|---|---|
| ***E05F 5/02*** | (2006.01) |
| ***E05C 19/18*** | (2006.01) |
| ***E05C 17/54*** | (2006.01) |
| ***E05C 17/00*** | (2006.01) |
| *E05B 17/00* | (2006.01) |

(52) U.S. Cl.

CPC ..... *E05C 17/54* (2013.01); *E05C 17/025* (2013.01); *E05B 17/0083* (2013.01); *Y10S 292/15* (2013.01); *Y10S 292/17* (2013.01); *Y10T 70/40* (2015.04)

(58) Field of Classification Search

CPC ..... E05C 17/00; E05C 17/02; E05C 17/025; E05C 17/047; E05C 17/166; E05C 17/54; E05C 19/182; E05C 19/184; E05C 19/188; E05B 65/0007; E05B 17/0083; Y10S 292/15; Y10S 292/17; Y10T 70/40

USPC ..... 70/DIG. 49, 14, 91, 93, 94, 101, 70/DIG. 17, 58; 292/288, 297, 338, 339, 292/342, 343, DIG. 15, DIG. 17; 16/82, 16/86 B, 375; 49/383, 384; D8/330, 331, D8/336–338, 400, 402, 403

See application file for complete search history.

(56) References Cited

U.S. PATENT DOCUMENTS

| | | | | | |
|---|---|---|---|---|---|
| 1,197,228 | A | * | 9/1916 | Nelson | 70/90 |
| 1,664,174 | A | * | 3/1928 | Hoopes, Jr | 292/344 |
| 3,732,709 | A | * | 5/1973 | Kneebone | 70/90 |
| 3,844,145 | A | * | 10/1974 | Kneebone | 70/90 |
| 4,036,039 | A | * | 7/1977 | Nakanishi | 70/90 |
| 4,059,299 | A | * | 11/1977 | Huntley | 292/294 |

(Continued)

FOREIGN PATENT DOCUMENTS

| | | | |
|---|---|---|---|
| GB | 194965 | A | 3/1923 |
| GB | 484827 | A | 5/1938 |
| WO | 9927217 | A1 | 6/1996 |

*Primary Examiner* — Lloyd Gall

(74) *Attorney, Agent, or Firm* — Levenfeld Pearlstein, LLC

(57) ABSTRACT

A door stop includes a body having a longitudinal axis and a rotating toggle operably connected to the body. The toggle is rotatable such that a longitudinal axis of the toggle aligns with the longitudinal axis of the body in an insertion position and the longitudinal axis of the toggle is transverse to the longitudinal axis of the body in a locked position. The door stop includes a lock assembly operably mounted to the body to lock the toggle. Monitoring circuitry provides indication of a location of the door stop and/or an alarm mode.

12 Claims, 9 Drawing Sheets

(56) References Cited

U.S. PATENT DOCUMENTS

| | | | | | |
|---|---|---|---|---|---|
| 4,439,758 | A | * | 3/1984 | Cantley | 340/546 |
| D286,015 | S | * | 10/1986 | Johnson | D8/402 |
| 4,831,688 | A | * | 5/1989 | Deininger | 16/319 |
| 4,878,267 | A | * | 11/1989 | Roach et al. | 16/250 |
| 4,983,947 | A | * | 1/1991 | Mullen et al. | 340/426.28 |
| 5,027,471 | A | * | 7/1991 | Barnes | 16/86 R |
| 5,168,258 | A | * | 12/1992 | Radke | 340/542 |
| 5,311,168 | A | * | 5/1994 | Pease et al. | 340/542 |
| 5,450,652 | A | * | 9/1995 | Webb | 16/82 |
| 5,509,235 | A | * | 4/1996 | Chander | 49/383 |
| 5,511,837 | A | * | 4/1996 | Dempsey et al. | 292/288 |
| 5,564,294 | A | * | 10/1996 | Chen | 70/1 |
| 5,587,702 | A | * | 12/1996 | Chadfield | 340/542 |
| 5,595,075 | A | * | 1/1997 | Chen | 70/95 |
| 5,598,725 | A | * | 2/1997 | Chang | 70/209 |
| 5,711,557 | A | * | 1/1998 | Nicolosi | 292/288 |
| 6,170,304 | B1 | * | 1/2001 | Ohta | 70/14 |
| D455,644 | S | * | 4/2002 | Coffey | D8/402 |
| 6,389,853 | B1 | * | 5/2002 | Pate et al. | 70/18 |
| 6,520,551 | B1 | * | 2/2003 | Crnkovich | 292/288 |
| 7,158,029 | B1 | * | 1/2007 | Martyn | 340/545.7 |
| D538,149 | S | * | 3/2007 | Yarde et al. | D8/402 |
| 7,374,213 | B2 | * | 5/2008 | Carlson | 292/343 |
| 7,506,905 | B1 | * | 3/2009 | George | 292/343 |
| 7,559,114 | B2 | * | 7/2009 | Ranilovich | 16/82 |
| D603,694 | S | * | 11/2009 | Bushey | D8/402 |
| D604,156 | S | * | 11/2009 | Healy | D8/402 |
| 7,786,884 | B1 | * | 8/2010 | McRoskey | 340/686.1 |
| 7,904,992 | B2 | * | 3/2011 | Agster et al. | 16/82 |
| 7,950,570 | B2 | * | 5/2011 | Marchasin et al. | 235/375 |
| 7,971,459 | B2 | * | 7/2011 | Price | 70/201 |
| 8,215,140 | B1 | * | 7/2012 | Gaines | 70/14 |
| 8,863,561 | B2 | * | 10/2014 | Orlov et al. | 70/14 |
| 2005/0161954 | A1 | * | 7/2005 | Miskin | 292/229 |
| 2007/0126248 | A1 | * | 6/2007 | Mintz | 292/342 |
| 2008/0277949 | A1 | * | 11/2008 | Emde et al. | 292/343 |
| 2009/0260182 | A1 | * | 10/2009 | Hall | 16/82 |
| 2010/0038921 | A1 | * | 2/2010 | Kirkham et al. | 292/343 |
| 2010/0175324 | A1 | * | 7/2010 | Cress | 49/70 |
| 2011/0254293 | A1 | * | 10/2011 | Duff et al. | 292/343 |
| 2012/0043770 | A1 | * | 2/2012 | Lau | 292/343 |
| 2012/0227448 | A1 | * | 9/2012 | Su | 70/58 |

* cited by examiner

DOOR STOP WITH SECURITY LOCK

CROSS-REFERENCE TO RELATED APPLICATION DATA

The present application claims the benefit of priority, and is a continuation-in-part of U.S. patent application Ser. No. 13/861,215, filed Apr. 11, 2013, the entirety of which is incorporated herein by reference.

BACKGROUND OF THE INVENTION

The present invention relates generally to a door stop and more particularly, to a door stop with a security lock to prevent inadvertent or unwanted closure of the door.

Door security for cleaning staff, nurses, realtors and the like in hotels, spas, hospitals and residences is essential. Most doors have locking systems barring unauthorized entry, especially forced entry. The greater protection against forced entry, the greater security enjoyed by the inhabitants. However, for cleaning staff, nurses and the like, these locking systems can be used against them by a perpetrator who locks the door behind them and uses the secured space to physically attack the victim. Once the door is locked, the locking system is no longer accessible from the outside and, therefore, cannot be opened from the outside by another to aid or protect the victim against the perpetrator. Therefore, in these types of situations it is desirable to secure complete opening of the door, and retain protection against forced closure of the door and unwanted creation of a closed or confined space.

Furthermore, a door security device to prevent a door completely or partially closing relative to a door frame is desirable in locations where egress access must be maintained or to prevent inadvertent injury to individuals, such as children and the like, in the closing of doors relative to a door frame structure.

As such, it will be appreciated that there is a need for a new and improved door stop. Desirably, such a door stop can be securely placed relative to a door frame to prevent complete or partial closure of the door and which cannot be easily removed by another. More desirably, such a door stop apparatus has a lock assembly to secure the door stop between the door and door jamb.

SUMMARY

A door stop includes a body having a longitudinal axis and a rotating toggle operably connected to the body. The toggle is rotatable such that a longitudinal axis of the toggle aligns with the longitudinal axis of the body in an insertion position and the longitudinal axis of the toggle is transverse to the longitudinal axis of the body in a locked position. A lock assembly is operably mounted to the body to lock the toggle.

Monitoring circuitry provide indications of a location of the door stop and/or an alarm mode. The monitoring circuitry can be positioned within the body and includes a power source such as a battery, a photocell or the like.

The alarm mode can be actuated by a switch and can include an audible indicator, such as a speaker, a visual indicator such as a light (e.g., an LED) or both. The speaker and/or light can be located on the body.

The door stop can also include a remote device, such as a hand-held device/transmitter. The alarm switch can be located on the hand-held device. The remote device can include circuitry to communicate with the monitoring circuitry in the door stop.

The monitoring circuitry can include circuitry to determine, remotely, the location of the device.

These and other features and advantages of the present invention will be apparent from the following detailed description, in conjunction with the appended claims.

DETAILED DESCRIPTION

Figure 1:
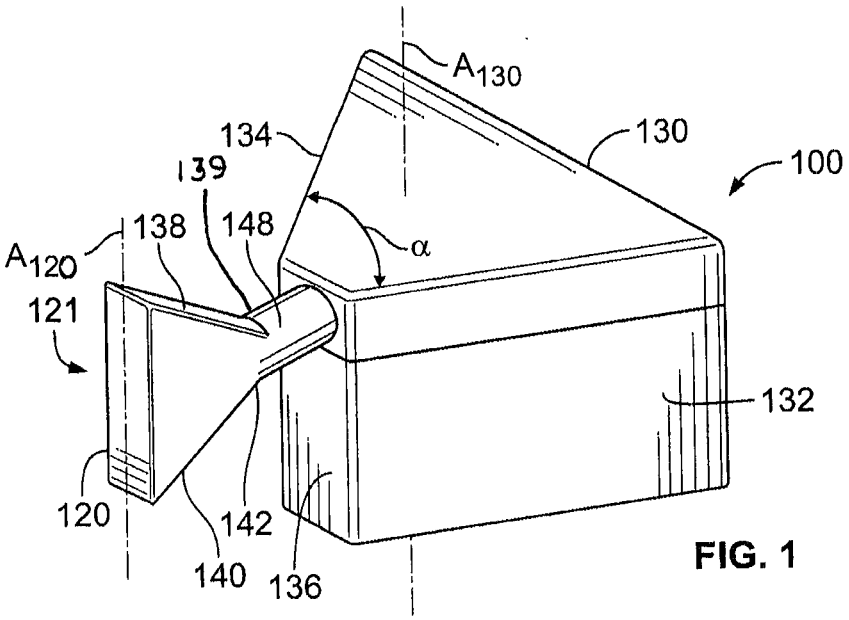
FIG. 1 is a perspective view of an embodiment of a door stop.

While the present device is susceptible of embodiment in various forms, there is shown in the figures and will hereinafter be described a presently preferred embodiment with the understanding that the present disclosure is to be considered an exemplification of the device and is not intended to be limited to the specific embodiment illustrated.

Turning now descriptively to the drawings, in which similar reference characters denote similar elements throughout the several views, FIGS. 1 through 7 illustrate an embodiment of an improved door stop.

The door stop 100 includes a body 130 and a rotating toggle 120. In an embodiment, the body 130 has a triangular wedge shaped body having a pair of sides 132, 134 formed at an angle $\alpha$ to one another. In the illustrated embodiment, the angle $\alpha$ is an acute angle. It will be appreciated that the body 130 is configured to fit between an inside surface S1 of a door D and a corresponding surface S2 of a door jamb J. The door and jamb surfaces S1, S2 typically form an acute angle ranging from about 0 degrees (when the door D is closed) to about 90 degrees when the door D is open. It will, however, be understood that the angle formed by the open door D can vary greatly from just a few degrees (slightly ajar) to close to 180 degrees when fully swept open, depending upon the type and placement of the hinges 210 mounting the door D to the jamb J. For purposes of the present disclosure, an open door D is a door that is opened to a desired position, likely greater than about 30 degrees and up to about 90 degrees, but perhaps greater than 90 degrees.

Figure 2:
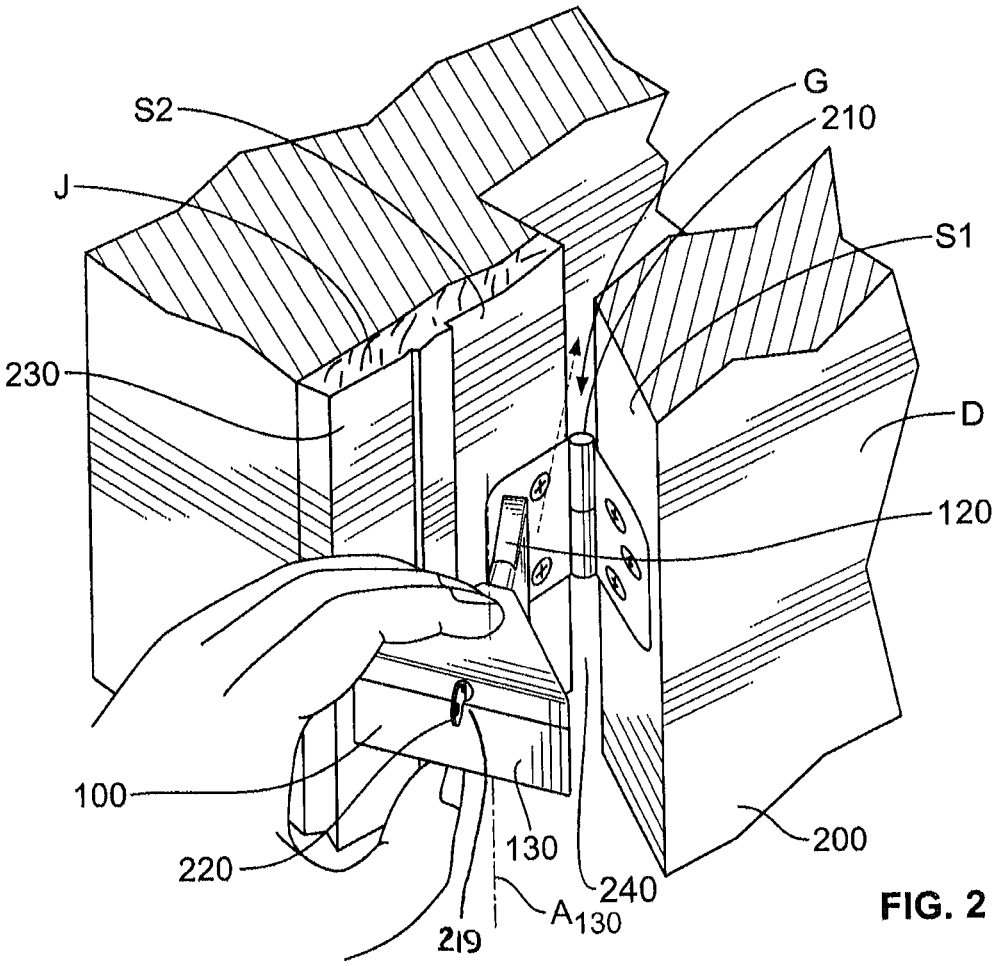
FIG. 2 illustrates the door stop of FIG. 1 ready for insertion between a door and door jamb, into the acute angle formed between the door and jamb.
Figure 5:
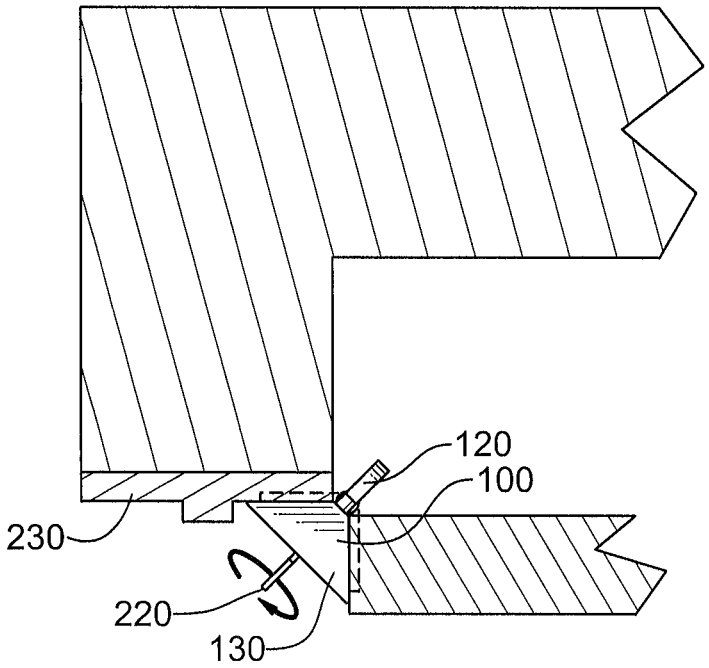
FIG. 5 is an elevational view illustrating the door stop positioned between the door and jamb and in the un-locked position.

The wedge-shaped body 130 sides 132, 134 which are formed at an angle α to one another define an apex or converging end 136. The body 130 also defines a longitudinal axis $A_{130}$, which, as seen in FIGS. 1 and 2, is the axis that is aligned with the door hinges 210. The rotating toggle 120 is mounted to body 130 at about the apex or converging end 136 and rotates between an insertion position (see, for example, FIG. 5) and a locked position (see, for example, FIG. 6). In an embodiment, the toggle 120 also has a generally wedge-shaped body 121 with sides 138, 140 that define an apex 139 and a longitudinal axis $A_{120}$, which extends along the long side of the body 121. The converging end 142 of the toggle 120 is proximal to the door stop body apex 136. The toggle 120 is rotatable such that the toggle 120 and body 130 oppose one another in the locked position (FIG. 6) and so that they are transverse to one another in another position, the insertion stop position (FIG. 5).

As illustrated in FIG. 2, in an embodiment, the door stop 100 can also include a lock and key assembly 219 mounted within the body 130. The key 220 in the lock can mimic the orientation of the rotating toggle 120. That is, as seen in FIG. 2, both the rotating toggle 120 and the key 220 in the lock and key assembly 219 are shown in the vertical or insertion position. The toggle 120 is mounted to the lock and key assembly 219 by a stub 148 extending between the assembly 140 and the toggle 120.

Figure 3:
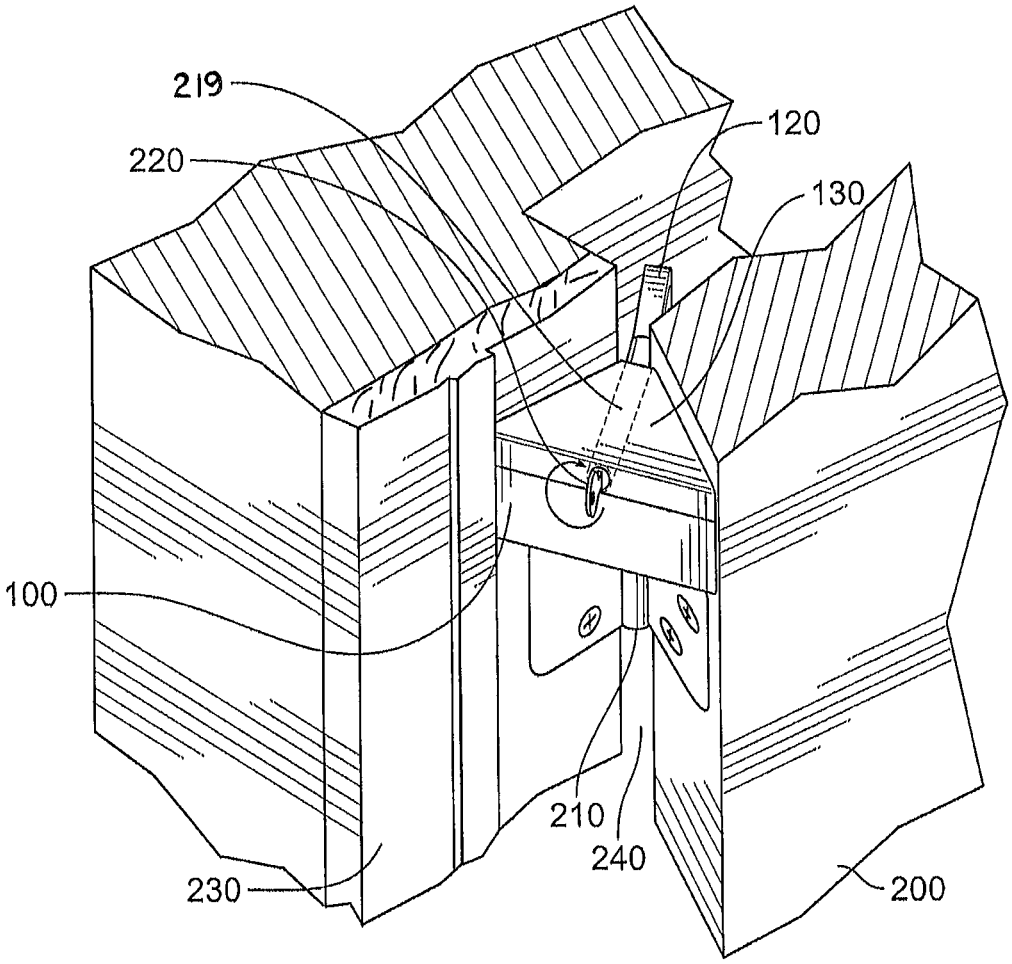
FIG. 3 illustrates the door stop of FIG. 2 inserted between the door and jamb.

To insert the door stop 100 between the door D and the jamb J, the door D is first opened sufficiently to insert the door stop 100. As seen in FIG. 3, with the toggle 120 in the insertion position, the door stop 100 is inserted into the gap G between the door D and jamb J, preferably above one of the door hinges 210, such that the toggle 120 is behind the door D and jamb J. The sides 132, 134 of the wedge-shaped body 130 are positioned on the inside door and jamb surfaces S1,S2.

Figure 4:
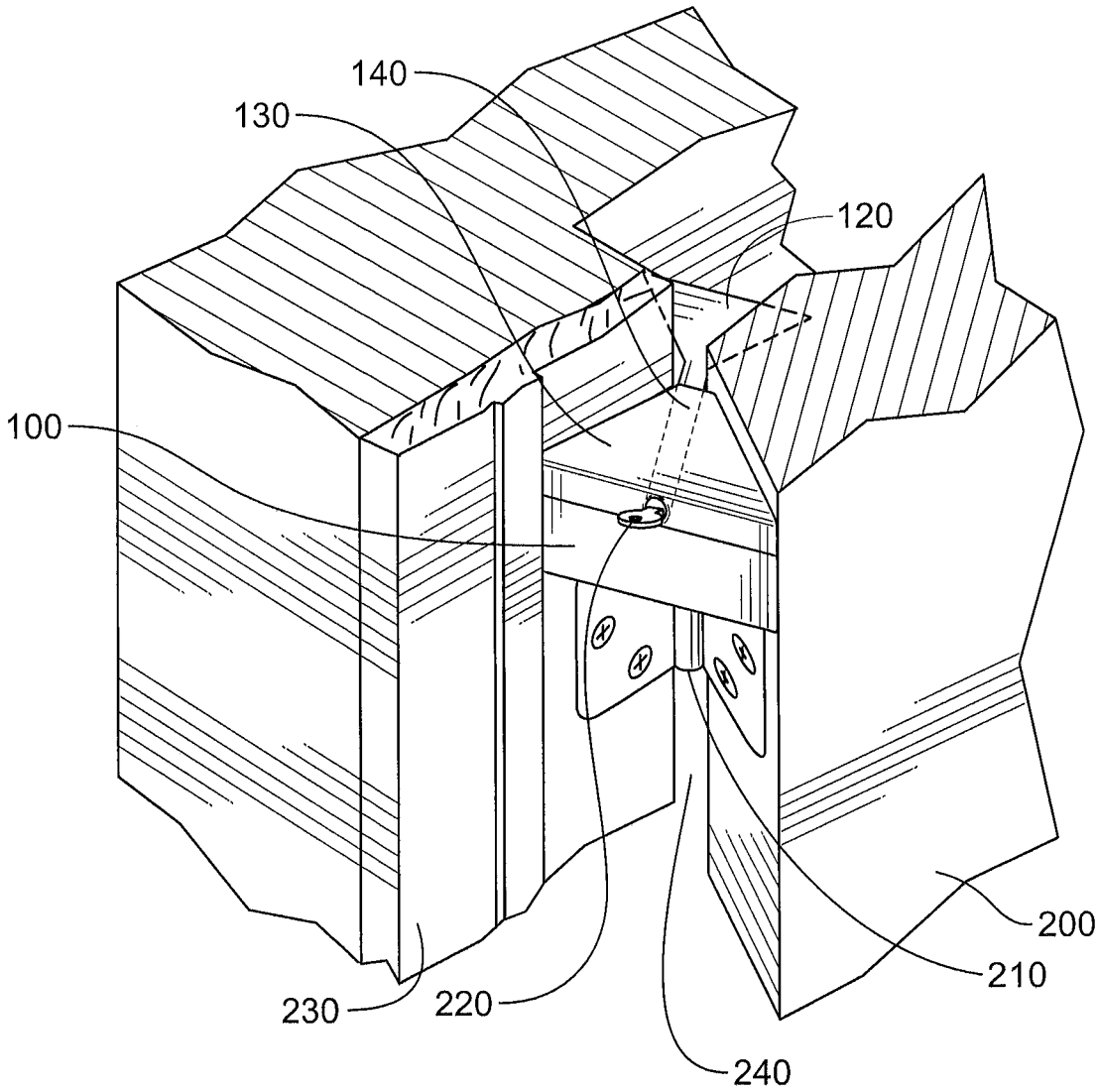
FIG. 4 illustrates the door stop in a locked position between the door and jamb, and relative to a hinge of the door structure.
Figure 6:
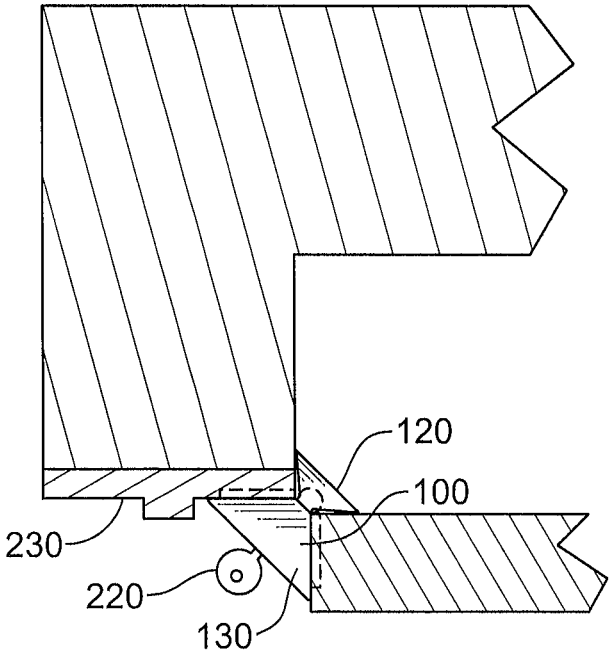
FIG. 6 is a view similar to FIG. 5 with the door stop in the locked position.

The key 220 is then turned, which in turn rotates the toggle 120 to the locked position as seen in FIGS. 4 and 6. Once the rotating toggle 120 is in a horizontal or "locked" position it locks behind the door D securing the door stop 100 within the door jamb J, with the stem portion of the toggle (or stub 148) traversing through the door jamb gap G. This anchors the door stop 100 in place. And, with the key 220 in the lock and key assembly 140 rotated to a horizontal position, this correspondingly rotates and locks the rotating toggle 120 to the locked or horizontal position. The key 220 can be removed from the lock and key assembly 140 and the rotating toggle 120 will remain in the locked position. In this manner, the door stop 100 cannot be removed from the door jamb gap G and as such the door D will remain in an open condition.

If a person tries to close the door D while the door stop 100 is in the horizontal or locked position, the toggle 120 (located behind the door D within the door jamb gap G), prevents the door stop 100 from being removed and thus the door D from closing. As noted above, the door stop 100 rests on top of the door hinge 210 so that the rigid door hinge 210 can support the pressure and avoid damage to both the door D and the door jamb J.

To remove the door stop 100, the user reinserts the key 220 into the lock and key assembly 140 and rotates the key 220 in the opposite direction so that both the key 220 and the rotating toggle 120 rotate to a vertical or insertion position (which, it will be understood, is also a removal position) allowing the door stop 100 to be removed from the door jamb J.

It should be appreciated that locking systems other than the illustrated key lock can be used in the present door stop. For example, as a combination lock, a U-lock, an electronic lock, a biometric lock and the like can be used to lock the door stop 100 in place in the door jamb J.

Figure 7:
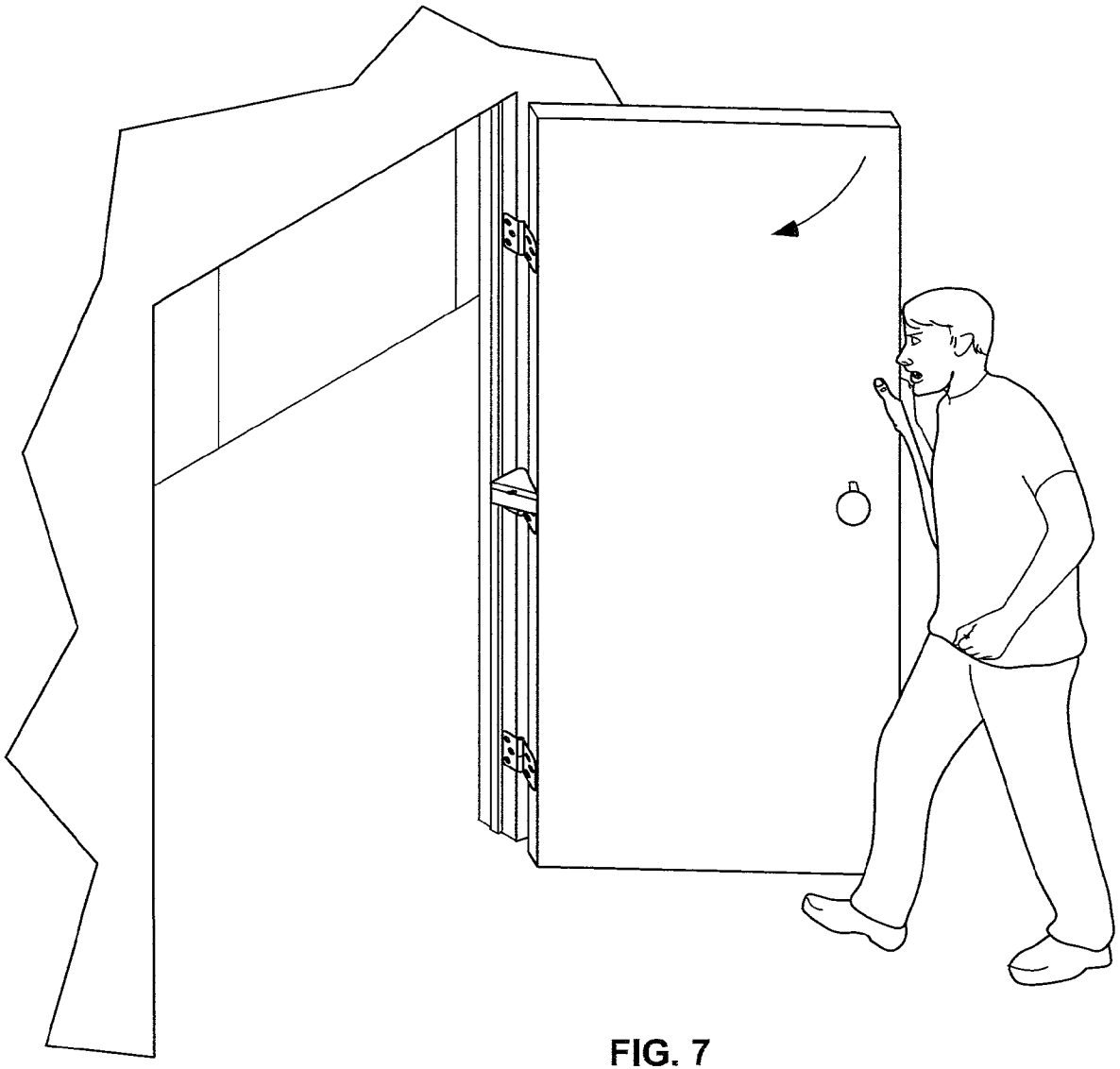
FIG. 7 is an illustration of an open door with the door stop positioned between the door and jamb, relative to a door hinge.
Figure 8:
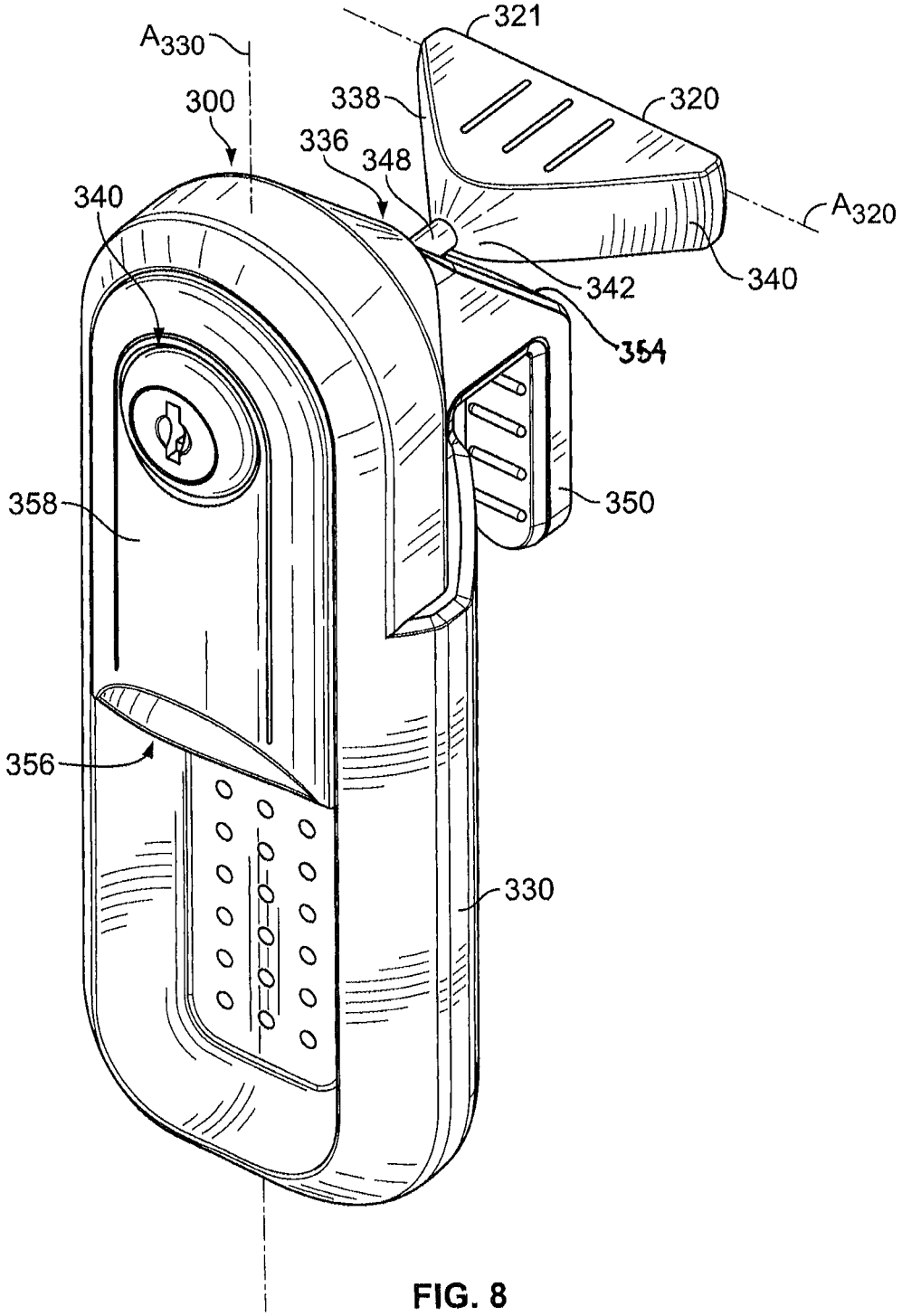
FIG. 8 is a top perspective view of an alternate embodiment of the door stop.

FIGS. 5 and 6 are elevational views of the door stop 100 with the lock and key assembly 140 (and key 220) and rotating toggle 120 in the insertion (or removal) position and in the locked position, respectively. As illustrated in FIG. 7, once the key 220 is turned to a horizontal position and the rotating toggle 120 is turned to a horizontal or locked position and the key 220 is removed from the lock and key assembly 140, the door stop 100 stays securely inserted within the door jamb gap G and the door D cannot be forced closed. This prevents a person from forcibly closing the door D and locking the door D when the door is meant to remain in an open condition (e.g., for security purposes, safety concerns, or the like).

Figure 9:
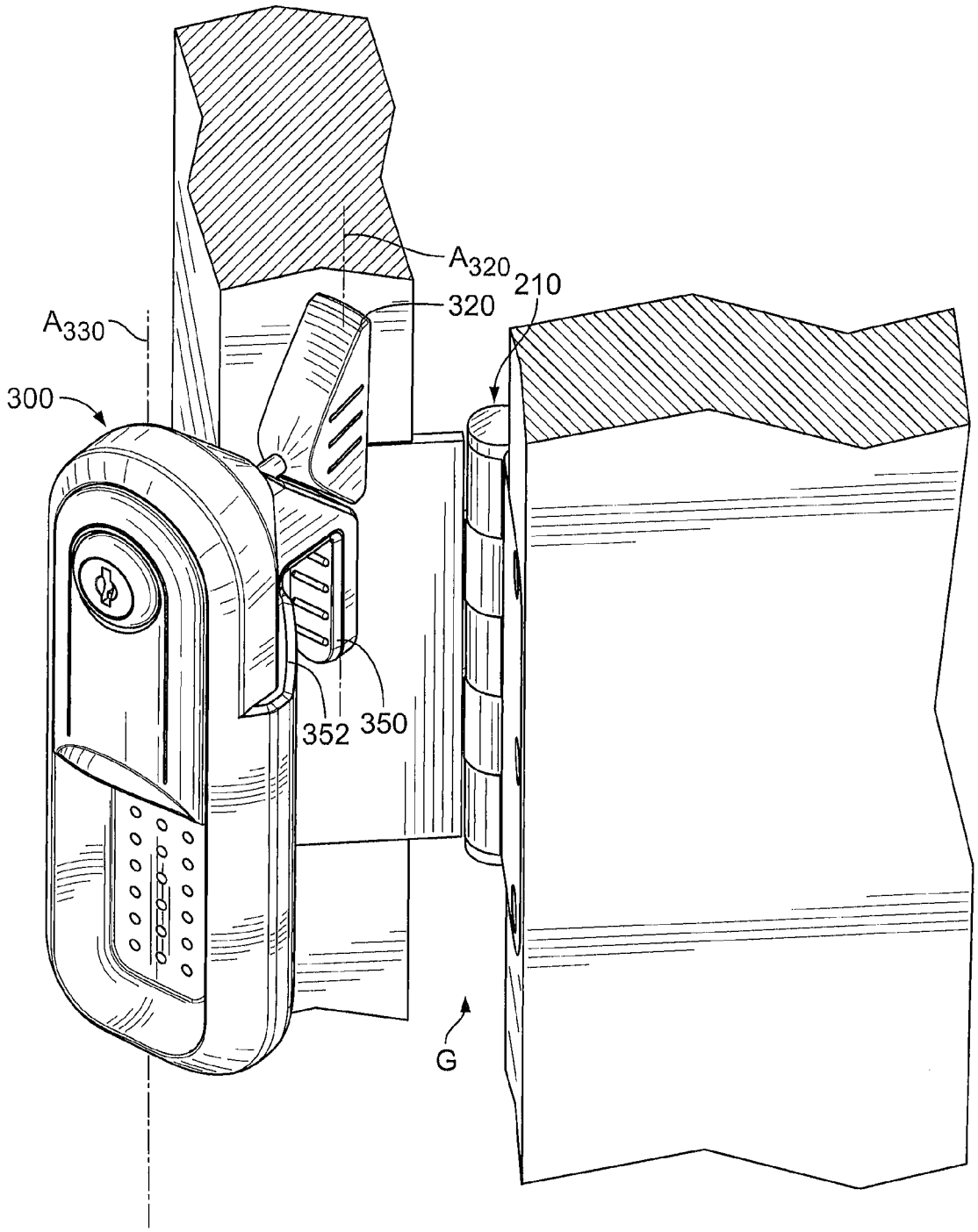
FIG. 9 is a view of the door stop similar to FIG. 8, showing the door stop in the insertion position with the toggle aligned with the door stop body and hook, prior to insertion into the door jamb.
Figure 10:
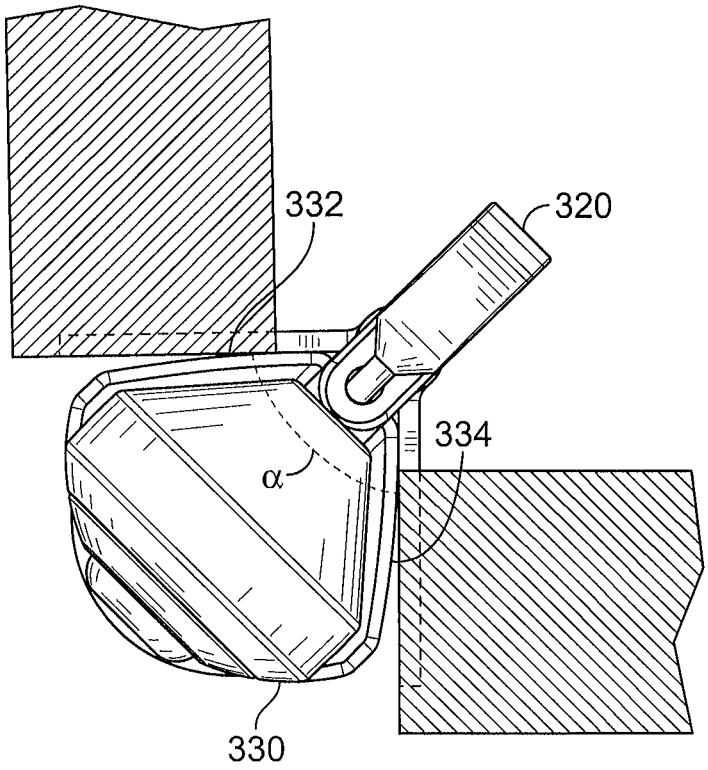
FIG. 10 is a top view of the door stop in the insertion position in the doorjamb.
Figure 11:
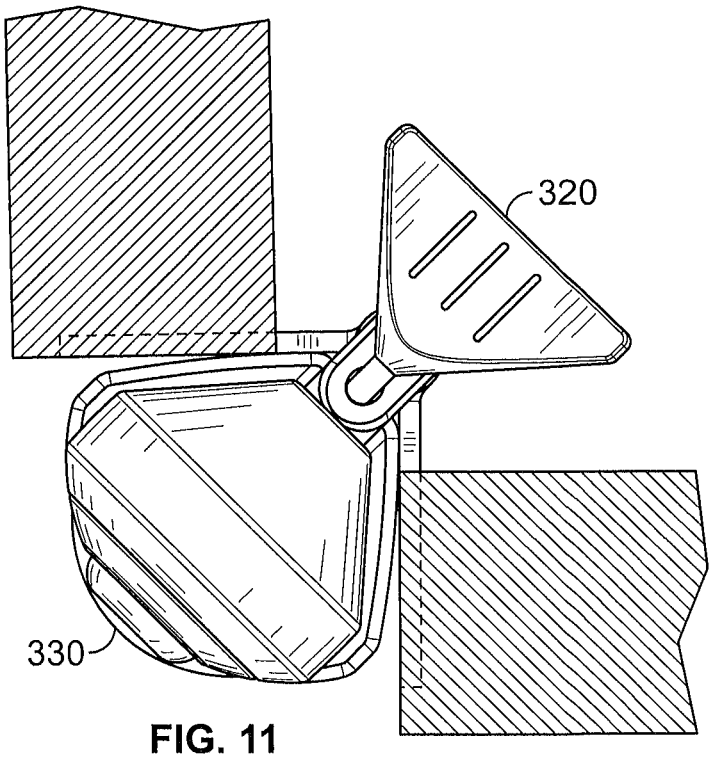
FIG. 11 is a top view of the door stop in the door jamb, in the locked position.

An alternate embodiment of the door stop 300 is illustrated in FIGS. 8-11. This ergonomically friendly embodiment includes a wedge-shaped body 330 having a pair of sides 332, 334 formed at an angle α to one another. The sides 332, 334 are formed at an angle α to one another to define an apex 336 or converging end. As best seen in FIGS. 10 and 11, the sides 332 and 334 can have a slightly outwardly bowed or curved shape to facilitate a smooth and proper engagement of the door stop 300 with the door D and jamb J, and to avoid damage to the door stop 300, and possibly the door D and jamb J in the event that the angle or dimensions/tolerances are not precise.

The body 330 also defines a longitudinal axis $A_{330}$, which, as seen in FIG. 9, is the axis that is aligned with the door hinge 210. The rotating toggle 320 is mounted to body 330 at the body apex 336 and rotates between an insertion position and a locked position.

The toggle 320 also has a generally wedge-shaped body 321 defining sides 338, 340 that define an apex 342 and a longitudinal axis $A_{320}$, which extends along the long side of the body 321. The apex 342 of the wedge 321 is proximal to the door stop body apex 336. As with the previous embodiment, the toggle 320 is rotatable such that the toggle 320 and body 330 oppose one another (the wedge-shaped bodies oppose one another in the locked position). In this embodiment the toggle is aligned with the body in one position, the insertion position (FIG. 10), and is transverse to the body in another position, the lock position (FIG. 11).

A lock assembly 340 is positioned in the body 330. The lock assembly 340 can be of a key-type lock, as illustrated. The lock assembly 340 is mounted to the toggle 320 by a stub 348 extending between the lock assembly 340 and the toggle 320. Again, rotating the key (not shown) in turn rotates the toggle 320 between the insertion and locked positions. Lock types other than a key, e.g., a combination lock, a U-lock, an electronic lock, a biometric lock and the like can be used.

In this embodiment, the body 330 includes a hook 350 extending from a rear portion 352 of the body 330 (at about the apex 336). In the illustrated embodiment, the hook 350 extends from the body 330, below the toggle 320. The hook 350 is configured so as to not interfere with rotation of the toggle 320. Again, as illustrated, the hook 350 is formed in the body 330, adjacent to and below the toggle 320, and has a sloping surface or cut-out as illustrated at 354 to accommodate the toggle 320 in the insertion (and removal) position. It has been found that the hook 350 reduces the stresses on the toggle 320, stub 348 and lock assembly 340 by the weight or force of the door D, and thus shifts most if not all of such stresses and/or forces on to the hook 350. As such, the hook 350, which can be formed as part of or mounted to the body 330, can be formed from a suitable material, such as a reinforced resin to withstand such forces/stresses.

This embodiment can also include a holding region as indicated at 356, such as the region formed between a cover 358 and the body 330. The holding region 356 which is defined by a concave recess in the body 330 and opposing convex cover 358, provides a place for a user to insert one or more fingers when inserting or removing the door stop 300 from the door jamb J. The holding region 356 provides the user with a secure place for the user's fingers when inserting or removing the door stop 300.

Figure 12:
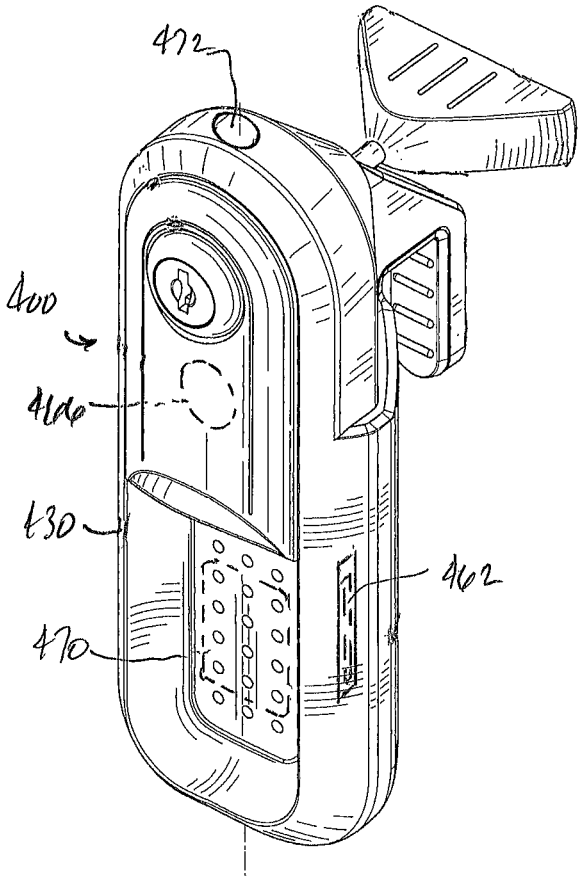
FIG. 12 is a perspective view similar to FIG. 10 illustrating an embodiment of the door stop with various additional features.
Figure 13:
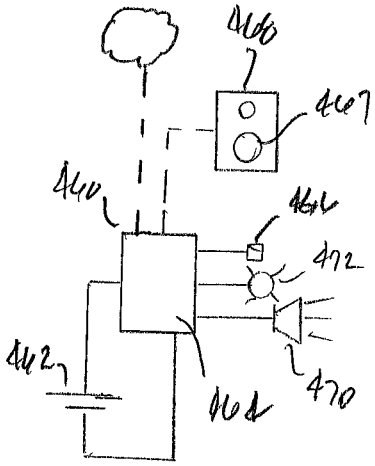
FIG. 13 illustrates an embodiment of circuitry and a control system for use with the door stop.

As illustrated in FIGS. 12 and 13, an embodiment 400 of the door stop can include a number of optional features. One such feature includes circuitry 460, e.g., electronics, to allow for remote location of the device 400. The circuitry 460 can be contained within the body 430 and can include a power source 462, such as a battery, photocell or the like, and a transmitter 464 to generate a location signal. The door stop 430 can also include a switch to indicate an alarm mode. For example, the switch can be a "panic button" 466 located on the device 400. Alternately, the panic button 467 can be located on a remote device, such as a remote transmitter 468, for example, a hand-held transmitter, associated with the device 400.

Audible and/or visual indicators, such as a speaker 470, a light 472 (e.g., an LED) or the like can also be incorporated into the device 400 to provide local indication of the alarm mode. The location signal generator 464 can also be used to generate a remote indication signal to a location, such as an office or a remote panel (for security, management or other monitoring) as appropriate.

With respect to the above description then, it is to be realized that the optimum dimensional relationships for the parts of the door stop, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

It will also be appreciated by those skilled in the art that the relative directional terms such as sides, upper, lower, rearward, forward and the like are for explanatory purposes only and are not intended to limit the scope of the disclosure.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

The invention claimed is:

1. A door stop, comprising:

a body having a longitudinal axis, and having angled sides defining an apex;

a rotating toggle operably connected to the body at about the body apex, the toggle rotatable such that a longitudinal axis of the toggle aligns with the longitudinal axis of the body in an insertion position and such that the longitudinal axis of the toggle is transverse to the longitudinal axis of the body in a locked position;

a lock assembly operably mounted to the body to lock the toggle; and monitoring circuitry.

2. The door stop of claim 1 wherein the monitoring circuitry is positioned within the body.

3. The door stop of claim 2 including a power source.

4. The door stop of claim 1 wherein the monitoring circuitry includes an alarm mode, and wherein the alarm mode includes an audible indicator.

5. The door stop of claim 1 wherein the monitoring circuitry includes an alarm mode, and wherein the alarm mode includes a visual indicator.

6. The door stop of claim 5 wherein visual indicator is located on the body.

7. The door stop of claim 1 including a remote device, wherein the remote device includes circuitry to communicate with the monitoring circuitry.

8. The door stop of claim 1 wherein the monitoring circuitry includes circuitry to determine the location of the door stop.

9. The door stop of claim 4 including a switch for actuating the alarm mode.

10. The door stop of claim 9 wherein the switch is located on the body.

11. The door stop of claim 7 including a switch, located on the remote device, to actuate an alarm mode.

12. The door stop of claim 10 including a cover and a holding region formed on a front of the body between the cover and the body, and wherein the switch is located within the holding region.

* * * * *